United States Patent [19]

Raybould et al.

[11] Patent Number: 5,071,474

[45] Date of Patent: Dec. 10, 1991

[54] METHOD FOR FORGING RAPIDLY SOLIDIFIED MAGNESIUM BASE METAL ALLOY BILLET

[75] Inventors: Derek Raybould, Denville; Chin-Fong Chang, Morris Plains; Santosh K. Das, Randolph, all of N.J.

[73] Assignee: Allied-Signal, Inc., Morristownship, Morris County, N.J.

[21] Appl. No.: 538,433

[22] Filed: Jun. 15, 1990

[51] Int. Cl.[5] ..... B22F 9/00

[52] U.S. Cl. ..... 75/249; 419/23; 419/28; 419/38; 419/54; 419/60

[58] Field of Search ..... 419/23, 28, 38, 54, 419/60; 75/249

[56] References Cited

U.S. PATENT DOCUMENTS

| | | | |
|---|---|---|---|
| 4,853,039 | 10/1989 | Das et al. | 75/249 |
| 4,857,109 | 8/1989 | Das et al. | 75/249 |
| 4,938,809 | 7/1990 | Das et al. | 75/249 |

*Primary Examiner*—Stephen J. Lechert, Jr.
*Assistant Examiner*—Leon Nigohosian, Jr.
*Attorney, Agent, or Firm*—Ernest D. Buff; Gerhard H. Fuchs

[57] ABSTRACT

A magnesium base metal component is forged from a billet by subjecting the billet to a forging process using multiple steps in a closed-die or an open-die forging and a forging temperature ranging from 200° C. to 300° C. The billet is compacted from a rapidly solidified magnesium based alloy defined by the formula $Mg_{bal}Al_aZn_bX_c$, wherein X is at least one element selected from the group consisting of manganese, cerium, neodymium, praseodymium, and yttrium, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent. The alloy has a uniform microstructure comprised of a fine grain size ranging from 0.2-1.0 μm together with precipitates of magnesium and aluminum containing intermetallic phases of a size less than 0.1 μm. Upon being forged, the component exhibits, in combination, excellent mechanical strength and ductility, making it especially suited for aerospace structural applications.

12 Claims, No Drawings

METHOD FOR FORGING RAPIDLY SOLIDIFIED MAGNESIUM BASE METAL ALLOY BILLET

1. FIELD OF INVENTION

This invention relates to a method of forging a magnesium base metal alloy billet consolidated from powders made by rapid solidification of the alloy, to achieve good mechanical properties.

2. DESCRIPTION OF THE PRIOR ART

Magnesium alloys are considered attractive candidates for structural use in aerospace and automotive industries because of their light weight, high strength to weight ratio, and high specific stiffness at both room and elevated temperatures.

The application of rapid solidification processing (RSP) in metallic systems results in the refinement of grain size and intermetallic particle size, extended solid solubility, and improved chemical homogeneity. By selecting the thermally stable intermetallic compound ($Mg_2Si$) to pin the grain boundary during consolidation, a significant improvement in the mechanical strength [0.2% yield strength (YS) up to 393 MPa, ultimate tensile strength (UTS) up to 448 MPa, elongation (El) up to 9%]can be achieved in RSP Mg-Al-Zn-Si alloys, [S.K. Das et al. U.S. Pat. No. 4,675,157, High Strength Rapidly Solidified Magnesium Base Metal Alloys, June 1987]. The addition of rare earth elements (Y, Nd, Pr, Ce) to Mg-Al-Zn alloys further improves corrosion resistance (11 mdd when immersed in 3% NaCl aqueous solution for $3.4\times10^5$ sec. at 27° C.) and mechanical properties (YS up to 435 MPa, UTS up to 476 MPa, El up to 14%) of magnesium alloys, [S.K. Das and C.F. Chang, U.S. Pat. No. 4,765,954, Rapidly Solidified High Strength Corrosion Resistant Magnesium Base Metal Alloys, August 1988].

The alloys are subjected to rapid solidification processing by using a melt spin casting method wherein the liquid alloy is cooled at a rate of $10^5$ to $10^7$ ° C./sec while being solidified into a ribbon or sheet. That process further comprises the provision of a means to protect the melt puddle from burning, excessive oxidation and physical disturbance by the air boundary layer carried with the moving substrate. The protection is provided by a shrouding apparatus which serves the dual purpose of containing a protective gas such as a mixture of air or $CO_2$ and $SF_6$, a reducing gas such as Co or an inert gas, around the nozzle while excluding extraneous wind currents which may disturb the melt puddle.

The as cast ribbon or sheet is typically 25 to 100 μm thick. The rapidly solidified ribbons are sufficiently brittle to permit them to be mechanically comminuted by conventional apparatus, such as a ball mill, knife mill, hammer mill, pulverizer, fluid energy mill. The comminuted powders are either vacuum hot pressed to about 95% dense cylindrical billets or directly canned to similar size. The billets or cans are then hot extruded to round or rectangular bars at an extrusion ratio ranging from 14:1 to 22:1.

Magnesium alloys, like other alloys with hexagonal crystal structures, are much more workable at elevated temperatures than at room temperature. The basic deformation mechanisms in magnesium at room temperature involve both slip on the basal planes along <1,1,2,0> directions and twinning in planes (1,0,1,2) and <1,0,−1,1> directions. At higher temperatures (>225° C.), pyramidal slip (1,0,−1,1) <1,1,2,0> becomes operative. The limited number of slip systems in the hcp magnesium presents plastic deformation conformity problems during working of a polycrystalline material. This results in cracking unless substantial crystalline rotations of grain boundary deformations are able to occur. For the fabrication of formed magnesium alloy parts, the fabrication temperature range between the minimum temperature to avoid alloy cracking and a maximum temperature to avoid alloy softening is quite narrow.

Work on metalworking of formed magnesium parts made from rapidly solidified magnesium alloys is relatively rare. Busk and Leontis [R.S. Busk and T. I. Leontis, "The Extrusion of Powdered Magnesium Alloys", TRANS. AIME. 188 (2)(1950), pp. 297–306] investigated hot extrusion of atomized powder of a number of commercial magnesium alloys in the temperature range of 316° C. (600° F.Chang, U.S. Pat. No. 4,765,954, )–427° C. (800° F.). The as-extruded properties of alloys extruded from powder were not significantly different from the properties of extrusions from permanent mold billets.

In the study reported by Isserow and Rizzitano [S. Isserow and F. J. Rizzitano, "Microquenched Magnesium ZK60A Alloy", *International J. of Powder Metallurgy and Powder Technology*, 10 (3)(1974), pp. 217–227] on commercial ZK60A magnesium alloy powder made by a rotating electrode process, extrusion temperatures varying from ambient to 371° C. (700° F.) were used. The mechanical properties of the room temperature extrusions were significantly better than those obtained by Busk and Leontis but those extruded at 121° C. (250° F.) did not show any significant difference between the conventionally processed and rapidly solidified material. However, care must be exercised in comparing their mechanical properties in the longitudinal direction from room temperature extrusions since they observed significant delamination on the fracture surfaces; and properties may be highly inferior in the transverse direction.

Previous application [S.K. Das et al. "Superplastic Forming of Rapidly Solidified Magnesium Base Metal Alloys", U.S. Appl. Ser. No. 197,796, filed May 23, 1988 now U.S. Pat. No. 4,938,809 a method of superplastic forming of an extrusion composed of rapidly solidified magnesium base metal alloys to a complex part, to achieve a combination of good formability to complex net shapes and good mechanical properties of the articles. The superplastic forming allows deformation to near net shape.

Forging is one of primary mechanical working processes using direct-compression process to reduce an ingot or billet to a standard shaped mill product, such as sheet, plate, and bar.

The forgeability of conventional processed magnesium alloys depends on three factors: the solidus temperature of the alloy, the deformation rate, and the grain size. Magnesium alloys are often forged within 55° C. (100° F.) of their solidus temperature [Metals Handbook, Forming and Forging, Vol. 14, 9th ed., ASM International, 1988, pp. 259–260]. An exception is the high-zinc alloy ZK60, which sometimes contains small amounts of the low-melting eutectic that forms during ingot solidification. Forging of this alloy above about 315° C. (600° F.)—the melting point of the eutectic—can cause severe rupturing. The problem can be minimized by holding the cast ingot for extended periods at an elevated temperature to dissolve the eutectic and to restore a higher solidus temperature.

The mechanical properties developed in magnesium forgings depend on the strain hardening induced during forging. Strain hardening can be achieved by keeping the forging temperature as low as practical; however, if temperatures are too low, cracking will occur.

In a multiple forging operation process, the forging temperature should be adjusted downward for each subsequent operation to avoid recrystallization and grain growth. In addition to controlling grain growth, the reduction in temperature allows for residual strain hardening after the final operation.

There remains a need in the art for a method of forging a magnesium alloy billets consolidated from powders made by rapid solidification of the alloy to achieve good mechanical properties.

SUMMARY OF THE INVENTION

The present invention provides a method of forging a magnesium base alloy billet consolidated from powders made by rapid solidification of the alloy. The present invention avoids the extrusion operation necessary in all prior art. Generally stated, the alloy has a composition consisting of the formula $Mg_{bal}Al_aZn_bX_c$, wherein X is at least one element selected from the group consisting of manganese, cerium, neodymium, praseodymium, and yttrium, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent.

The magnesium alloys used in the present invention are subjected to rapid solidification processing by using a melt spin casting method wherein the liquid alloy is cooled at a rate of $10^5$ to $10^7$° C./sec while being formed into a solid ribbon or sheet. That process further comprises the provision of a means to protect the melt puddle from burning, excessive oxidation and physical disturbance by the air boundary layer carried with the moving substrate. Said protection is provided by a shrouding apparatus which serves the dual purpose of containing a protective gas such as a mixture of air or $CO_2$ and $SF_6$, a reducing gas such as Co or an inert gas, around the nozzle while excluding extraneous wind currents which may disturb the melt puddle.

The alloying elements manganese, cerium, neodymium, praseodymium, and yttrium, upon rapid solidification processing, form a fine uniform dispersion of intermetallic phase such as $Mg_3Ce$, $Mg_3Nd$, $Al_2Nd$, $Mg_3Pr$, $Al_2Y$, depending on the alloy composition. These finely dispersed intermetallic phases increase the strength of the alloy and help to maintain a fine grain size by pinning the grain boundaries during consolidation of the powder at elevated temperature. The addition of the alloying elements, such as: aluminum and zinc, contributes to strength via matrix solid solution strengthening and by formation of certain age hardening precipitates such as $Mg_{17}Al_{12}$ and MgZn.

The forging of the present invention is produced from a metal alloy billet made by compacting powder particles of the magnesium based alloy. The powder particles can be warm pressed by heating in a vacuum to a pressing temperature ranging from 150° C. to 275° C., which minimizes coarsening of the dispersed, intermetallic phases, to form a billet. The billet can be forged at temperatures ranging from 200° C. to 300° C. by a multiple step forging process.

The forging of the present invention possesses good mechanical Properties: high ultimate tensile strength (UTS) [up to 449 Mpa (65 ksi)] and good ductility (i.e. >5 percent tensile elongation) at room temperature. These properties are far superior to those of conventional magnesium alloys. The forgings are suitable for applications as structural members in helicopters, missiles and air frames where good corrosion resistance in combination with high strength and ductility is important.

DESCRIPTION OF THE PREFERRED EMBODIMENTS

In accordance with the present invention a forging is produced from a billet consolidated form rapidly solidified alloy powders. The alloy consists essentially of nominally pure magnesium alloyed with about 0 to 15 atom percent aluminum, about 0 to 4 atom percent zinc, about 0.2 to 3 atom percent of at least one element selected from the group consisting of manganese, cerium, neodymium, praseodymium, and yttrium, the balance being magnesium and incidental impurities, with the proviso that the sum of aluminum and zinc present ranges from about 2 to 15 atom percent. The alloy is melted in a protective environment; and quenched in a protective environment 15 at a rate of at least about $10^5$° C./sec by directing the melt into contact with a rapidly moving chilled surface to form thereby a rapidly solidified ribbon. Such alloy ribbons have high strength and high hardness (i.e. microVickers hardness of about 125 kg/mm$^2$). When aluminum is alloyed without addition of zinc, the minimum aluminum content is preferably above about 6 atom percent.

The alloys of the consolidated billet from which the forging of the invention have a very fine microstructure which is not resolved by optical micrograph. Transmission electron micrograph reveals a substantially uniform cellular network of solid solution phase ranging from 0.2–1.0 μm in size, together with precipitates of very fine, binary or ternary intermetallic phases which are less than 0.1 μm and composed of magnesium and other elements added in accordance with the invention.

The mechanical properties [e.g., 0.2% yield strength (YS) and ultimate tensile strength (UTS)] of the alloys of this invention are substantially improved when the precipitates of the intermetallic phases have an average size of less than 0.1 μm, and even more preferably an average size ranging from about 0.03 to 0.07 μm. The presence of intermetallic phase precipitates having an average size less than 0.1 μm pins the grain boundaries during consolidation of the powder at elevated temperature with the result that a fine grain size is substantially maintained during high temperature consolidation.

The as cast ribbon or sheet is typically 25 to 100 μm thick. The rapidly solidified materials of the above described compositions are sufficiently brittle to permit them to be mechanically comminuted by conventional apparatus, such as a ball mill, knife mill, hammer mill, pulverizer, fluid energy mill, or the like. Depending on the degree of pulverization to which the ribbons are subjected, different particle sizes are obtained. Usually the powder comprises platelets having an average thickness of less than 100 μm. These platelets are characterized by irregular shapes resulting from fracture of the ribbon during comminution.

The powder can be consolidated into fully dense bulk parts by known techniques such as hot isostatic pressing, and cold pressing followed by sintering, etc. Typically, the comminuted powders of the alloys of the present invention are vacuum hot pressed to cylindrical billets with diameters ranging from 50 mm to 110 mm and length ranging from 50 mm to 140 mm. The billets are preheated and forged at a temperature ranging from 200° C. to 300° C. at a rate ranging from 0.00021 m/sec to 0.00001 m/sec by a multiple step forging process. The billets have been forged in the closed-die at the thickness reduction of about 20–50%. Toward the final step samples have been open-die forged at the thickness reduction of about 50% without any serious cracking.

The microstructure obtained after consolidation depends upon the composition of the alloy and the consolidation conditions. Excessive times at high temperatures can cause the fine precipitates to coarsen beyond the optimal submicron size, leading to deterioration of the properties, i.e. a decrease in hardness and strength.

At room temperature (about 20° C.), the forging of the invention has a Rockwell B hardness of at least about 55 and is more typically higher than 65. Additionally, the ultimate tensile strength of the forging of the invention is at least about 378 MPa (55 ksi).

The following examples are presented in order to provide a more complete understanding of the invention. The specific techniques, conditions, materials and reported data set forth to illustrate the invention are exemplary and should not be construed as limiting the scope of the invention.

EXAMPLE 1

Ribbon samples were cast in accordance with the procedure described above by using an over pressure of argon or helium to force molten magnesium alloy through the nozzle onto a water cooled copper alloy wheel rotated to produce surface speeds of between about 900 m/min and 1500 m/min. Ribbons were 0.5–2.5 cm wide and varied from about 25 to 100 μm thick.

The nominal compositions of the alloys based on the charge weight added to the melt are summarized in Table 1 altogether with their as-cast hardness values The hardness values are measured on the ribbon surface which is facing the chilled substrate; this surface being usually smoother than the other surface. The microhardness of these Mg-Al-Zn-X alloys of the present invention ranges from 140 to 200 kg/mm$^2$. The as-cast hardness increases as the rare earth content increases. The hardening effect of the various rare earth elements on Mg-Al-Zn-X alloys is comparable. For comparison, also listed in Table 1 is the hardness of a commercial corrosion resistant high purity magnesium AZ91C-HP alloy. It can be seen that the hardness of the present invention is higher than commercial AZ91C-HP alloy.

TABLE 1

| Sample | Composition Nominal (At %) | Hardness (kg/mm$^2$) |
|---|---|---|
| Microhardness Values of R.S. Mg—Al—Zn—X As Cast Ribbons | | |
| 1 | $Mg_{92.5}Zn_2Al_5Ce_{0.5}$ | 151 |
| 2 | $Mg_{92}Zn_2Al_5Ce_1$ | 186 |
| 3 | $Mg_{92.5}Zn_2Al_5Pr_{0.5}$ | 150 |
| 4 | $Mg_{91}Zn_2Al_5Y_2$ | 201 |
| 5 | $Mg_{88}Al_{11}Mn_1$ | 162 |
| 6 | $Mg_{88.5}Al_{11}Nd_{0.5}$ | 140 |
| 7 | $Mg_{92}Zn_2Al_5Nd_1$ | 183 |

TABLE 1-continued

| Sample | Composition Nominal (At %) | Hardness (kg/mm$^2$) |
|---|---|---|
| ALLOY OUTSIDE THE SCOPE OF THE INVENTION Commercial Alloy AZ91C-HP | | |
| 8 | $(Mg_{91.7}Al_8Zn_{0.2}Mn_{0.1}$ | 116 |

EXAMPLE 2

The rapidly solidified ribbons of the present invention were subjected first to knife milling and then to hammer milling to produce −40 mesh powders. The powders were vacuum outgassed and hot pressed to billets (3" diameter × 3" height) at 200° C.–275° C. Tensile samples were machined from the billet and tensile properties were measured in uniaxial tension at a strain rate of about $5.5 \times 10^{-4}$/sec at room temperature. The tensile properties measured at room temperature had near zero ductility.

TABLE 2

| Room Temperature Properties of Rapidly Solidified Mg—Al—Zn—Nd Alloy Billet, (3.0" D × 3.0" H) | | | |
|---|---|---|---|
| Composition Nominal (At %) | Y.S. (MPa) | U.T.S. (MPa) | El. (%) |
| $Mg_{92}Zn_2Al_5Nd_1$ | — | 308 | 0.0 |
| | — | 337 | 0.6 |

EXAMPLE 3

The rapidly solidified ribbons of the present invention were subjected first to knife milling and then to hammer milling to produce −40 mesh powders. The powders were vacuum outgassed and hot pressed to billets (3" diameter × 3" height) at 200° C.–275° C. The billets were preheated and forged to pancake (5.5" diameter × ¾" height) at temperatures ranging from 200° C. to 300° C. by five step forging process using flat dies. The billets were closed-die forged at the thickness reduction of about 20–25% during the first four steps. At the fifth step, samples were open-die forged at the thickness reduction of about 50%. Tensile samples were machined from the forging about 4" from the edge and along the transverse direction and tensile properties were measured in uniaxial tension at a strain rate of about $5.5 \times 10^{-4}$/sec at room temperature. The tensile properties measured at room temperature are summarized in Table 3. As compared to the mechanical properties of the billet of the same alloy listed in Table 2, the improvement of tensile strength and ductility due to forging is evident.

TABLE 3

| Room Temperature Properties of Rapidly Solidified Mg—Al—Zn—Nd Alloy Pancake Forging (5.5" D × ¾" H), by Five Step Forging Process | | | | | |
|---|---|---|---|---|---|
| Composition Nominal (At %) | Forging Temp.(°C.) | Sample No. | Y.S. (MPa) | U.T.S. (MPa) | El. (%) |
| $Mg_{92}Zn_2Al_5Nd_1$ | 200 | 1 | 451 | 504 | 5.0 |
| | | 2 | 469 | 489 | 2.8 |
| | | 3 | 457 | 477 | 1.4 |
| | | 4 | 466 | 482 | 3.2 |
| | 260 | 5 | 400 | 438 | 3.1 |
| | | 6 | 413 | 442 | 4.8 |
| | | 7 | 417 | 449 | 6.0 |
| | 300 | 8 | 433 | 457 | 4.9 |
| $Mg_{92}Zn_2Al_5Nd_1$ | 300 | 9 | 440 | 461 | 6.3 |
| | | 10 | 431 | 449 | 4.3 |
| | | 11 | 424 | 442 | 2.8 |

EXAMPLE 4

The rapidly solidified ribbons of the present invention were subjected first to knife milling and then to hammer milling to produce −40 mesh powders. The powders were vacuum outgassed and hot pressed to billets (3"diameter×3" height) at 200° C.-275° C. The billets were forged to pancake (5.5" diameter×¾" height) at temperatures ranging from 200° C. to 300° C. by five step forging process using flat dies. The billets were closed-die forged at the thickness reduction of about 20-25% during the first four steps. At the fifth step, samples were open-die forged at the thickness reduction of about 50%. Samples were then cut from pancake (¾" height) and open-die forged to ¼" height. Tensile samples were machined from the forging about 4" from the edge along the transverse direction and tensile properties were measured in uniaxial tension at a strain rate of about $5.5\times10^{-4}$/sec at room temperature. The tensile properties measured at room temperature are summarized in Table 4. As compared to the mechanical properties listed in Table 3, the improvement in ductility of the forging due to the additional working is evident.

Both the yield strength (YS) and ultimate tensile strength (UTS) of the present invention are exceptionally high. For example, $Mg_{92}Zn_2Al_5Nd_1$ has a yield strength of 410 MPa, and UTS of 458 MPa which is similar to that of conventional aluminum alloys such as 7075. The density of the magnesium alloys is only 1.93 g/c.c. as compared with a density of 2.75 g/c.c. for conventional aluminum alloys. On a specific strength (strength/density) basis the magnesium based alloys provide a distinct advantage in aerospace applications. The ductility of the alloy of the present invention is quite good and suitable for engineering applications. For example, $Mg_{92}Zn_2Al_5Nd_1$ has a yield strength of 410 MPa, UTS of 458 MPa, and elongation of 9%, which is superior to the commercial alloys ZK60A, AZ91C-HP, when combined strength and ductility is considered. The alloys of the present invention can find use in military and aerospace applications such as air frames where high strength is required.

TABLE 4

| Composition Nominal (At %) | Forging Temp.(°C.) | Sample No. | Y.S. (MPa) | U.T.S. (MPa) | El. (%) |
|---|---|---|---|---|---|
| Room Temperature Properties of Rapidly Solidified Mg—Al—Zn—Nd Alloy Pancake Forging, (¼" H), by Six Step Forging Process | | | | | |
| $Mg_{92}Zn_2Al_5Nd_1$ | 250 | 1 | 402 | 442 | 5.4 |
| | | 2 | 410 | 448 | 9.4 |
| | 300 | 3 | 401 | 450 | 7.8 |
| | | 4 | 408 | 454 | 9.4 |
| ALLOYS OUTSIDE THE SCOPE OF THE INVENTION | | | | | |
| Commercial Alloy ZK60A-T5 ($Mg_{97.7}Zn_{2.1}Zr_{0.2}$) | | | 303 | 365 | 11.0 |
| AZ91CHP-T6 ($Mg_{91.7}Al_{8.0}Zn_{0.2}Mn_{0.1}$) | | | 131 | 276 | 5.0 |

EXAMPLE 5

The rapidly solidified ribbons of the present invention were subjected first to knife milling and then to hammer milling to produce −40 mesh powders. The powders were vacuum outgassed and hot pressed to billets, (3" diameter×3" height) at 200° C. to 275° C. The billets were forged to pancake (5.5" diameter×¾" height) at 300° C. by 4 step forging process using flat dies. The billets were closed-die forged at the thickness reduction of about 20-50% during the first three steps. During the fourth step, samples were open-die forged at the thickness reduction of about 50%. Tensile samples were machined from the forging about 4" from the edge and along the transverse direction. Tensile properties were measured in uniaxial tension at a strain rate of about $5.5\times10^{-4}$/sec at room temperature. The tensile properties measured at room temperature are summarized in Table 5.

TABLE 5

| Composition Nominal (At %) | Forging Temp (°C.) | Sample No. | Y.S. (MPa) | U.T.S. (MPa) | El. (%) |
|---|---|---|---|---|---|
| Room temperature properties of rapidly solidified Mg—Al—Zn—Nd Alloy Pancake Forging, (5.5" D × ¾" H) by four step forging process. | | | | | |
| $Mg_{92}Zn_2Al_5Nd_1$ | 300 | 1 | 418 | 437 | 8.7 |
| | | 2 | 414 | 448 | 6.9 |
| | | 3 | 415 | 443 | 7.3 |

What is claimed:

1. A method of forging a magnesium base metal alloy billet comprising the steps of: compacting a rapidly solidified magnesium based alloy powder to produce a billet, said alloy being defined by the formula $Mg_{bal}Al_aZn_bX_c$, wherein X is at least one element selected from the group consisting of manganese, cerium, neodymium, praseodymium, and yttrium, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent and having a microstructure comprised of a substantially uniform cellular network solid solution phase of a size ranging from 0.2-1.0 μm together with precipitates of magnesium and aluminum containing intermetallic phases of a size less than 0.1 μm; and forging said billet by subjecting it to a forging process using a closed-die or an open-die forging.

2. A method of forging a magnesium alloy billet as recited in claim 1, wherein said forging steps are carried out at a temperature ranging from 200° C. to 300° C.

3. A method of forging a magnesium alloy as recited by claim 1, wherein said forging deforms the billet by over 80%.

4. A process as recited by claim 1, wherein said compacting step is a vacuum hot pressing step.

5. A process as recited by claim 4, wherein said billet has a cylindrical shape.

6. A process as recited by claim 4, wherein said forging step comprises the steps of:

(i) preheating said billet to a temperature ranging from 200° C. to 300° C.;

(ii) forging said preheated billet at a rate ranging from 0.00021 m/sec to 0.00001 m/sec; and (iii) repeating step (ii) at least 3 additional times.

7. A process as recited by claim 6, wherein said powder is comprised of platelets having an average thickness of less than 100 μm.

8. A process as recited by claim 6, wherein at about 20° C. said forging has a Rockwell B hardness of at least about 55 and an ultimate tensile strength of at least about 378 MPa (55 ksi).

9. A magnesium base metal component forged from a billet, said billet having been produced by compacting an alloy defined by the formula $Mg_{bal}Al_aZn_bX_c$, wherein X is at least one element selected from the group consisting of manganese, cerium, neodymium, praseodymium, and yttrium, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent, and having a microstructure comprised of a substantially uniform cellular network solid solution phase of a size ranging from 0.2–1.0 μm together with precipitates of magnesium and aluminum containing intermetallic phases of a size less than 0.1 μm, and said component having been forged by subjecting said billet to a forging process having at least four forging steps using a closed-die or an open-die forging.

10. A component as recited by claim 8, wherein said forging steps are carried out at a temperature ranging from 200° C. to 300° C.

11. A component as recited by claim 9, wherein said billet has a cylindrical shape.

12. A component as recited by claim 10, wherein said component has a Rockwell B hardness of at least about 55 and an ultimate tensile strength of at least about 378 MPa (55 ksi).

* * * * *